US011161675B2

(12) United States Patent
Reed et al.

(10) Patent No.: US 11,161,675 B2
(45) Date of Patent: Nov. 2, 2021

(54) SOLUTION MIXING AND DISPENSING CONTAINER SYSTEM HAVING A CARTRIDGE RELEASE MECHANISM

(71) Applicant: Callington Haven Pty Ltd., Rydalmere (AU)

(72) Inventors: Alex Reed, Fisherville, KY (US); Jonathan Bostock, New Orleans, LA (US)

(73) Assignee: Callington Haven Pty Ltd., Rydalmere (AU)

( * ) Notice: Subject to any disclaimer, the term of this patent is extended or adjusted under 35 U.S.C. 154(b) by 0 days.

(21) Appl. No.: 17/170,376

(22) Filed: Feb. 8, 2021

(65) Prior Publication Data

US 2021/0253328 A1 Aug. 19, 2021

Related U.S. Application Data

(60) Provisional application No. 62/976,737, filed on Feb. 14, 2020, provisional application No. 63/034,170, filed on Jun. 3, 2020.

(51) Int. Cl.
*B05B 11/00* (2006.01)
*B65D 81/32* (2006.01)

(52) U.S. Cl.
CPC ..... *B65D 81/3222* (2013.01); *B05B 11/0081* (2013.01)

(58) Field of Classification Search
CPC ..... B65D 81/3222; B05B 11/0081; B05B 11/0054; B05B 15/30; B05B 11/0038; B05B 11/0037
See application file for complete search history.

(56) References Cited

U.S. PATENT DOCUMENTS 4,821,923 A * 4/1989 Skorka ..... B05B 11/0081 222/80
5,957,335 A 9/1999 Otto
(Continued)

FOREIGN PATENT DOCUMENTS

WO 2017123496 A1 7/2017

OTHER PUBLICATIONS

International Search Report corresponding to related International Application No. PCT/IB2021/054660, dated Aug. 5, 2021, 5 pages.
(Continued)

*Primary Examiner* — Vishal Pancholi
*Assistant Examiner* — Bob Zadeh
(74) *Attorney, Agent, or Firm* — K&L Gates LLP

(57) ABSTRACT

The present disclosure provides a new and innovative container system for mixing and dispensing a solution, such as a cleaning solution, that includes a container, dispenser, and a cartridge. The cartridge includes a reservoir containing a concentrated solution and a snap portion that closes the reservoir. The dispenser includes a sleeve that engages with the snap portion as part of a cartridge release mechanism to release the cartridge's concentrated solution into the container. As the dispenser's cap is tightened to the container, the dispenser's sleeve is forced downwards to engage the cartridge's snap portion and force the snap portion to disengage from the cartridge. The reservoir is therefore opened and its contents exit into the container's interior. As the dispenser's cap is disengaged from the container, the dispenser's sleeve is forced upwards, bringing the snap portion back to the cartridge and closing the reservoir.

20 Claims, 6 Drawing Sheets

(56) References Cited

U.S. PATENT DOCUMENTS

| | | | | |
|---|---|---|---|---|
| 6,041,969 | A * | 3/2000 | Parise | B05B 11/0078 206/219 |
| 6,182,865 | B1 * | 2/2001 | Bunschoten | B05B 11/0078 222/136 |
| 6,290,100 | B1 | 9/2001 | Yacko et al. | |
| 7,306,117 | B2 | 12/2007 | Roth et al. | |
| 9,604,766 | B2 * | 3/2017 | Dyrbye | B65D 51/2828 |
| 2009/0289025 | A1 * | 11/2009 | Mueller | B05B 11/0081 215/44 |
| 2010/0084430 | A1 * | 4/2010 | Sim | B05B 11/0056 222/129 |
| 2011/0031271 | A1 | 2/2011 | Foster | |
| 2015/0367368 | A1 * | 12/2015 | Scherer | B05B 11/3047 222/382 |

OTHER PUBLICATIONS

International Written Opinion corresponding to related International Patent Application No. PCT/IB2021/054660, dated Aug. 5, 2021, 5 pages.

* cited by examiner

SOLUTION MIXING AND DISPENSING CONTAINER SYSTEM HAVING A CARTRIDGE RELEASE MECHANISM

CROSS REFERENCE TO RELATED APPLICATIONS

The present application claims priority to and the benefit of U.S. Provisional Application No. 62/976,737, filed Feb. 14, 2020, the entirety of which is herein incorporated by reference. The present application also claims priority to and the benefit of U.S. Provisional Application No. 63/034,170 filed Jun. 3, 2020, the entirety of which is herein incorporated by reference.

BACKGROUND

Typically, cleaning solutions are formulated, packaged in a single-use container, and sold to consumers. Each time a consumer wants to purchase more of a particular cleaning solution, the consumer typically must buy another packaged single-use container of the cleaning solution. This process not only adds cost to consumers, who must pay for a new container each time they want more cleaning solution, but also creates a large amount of plastic waste as only a small portion of the containers are ever recycled. The plastic waste created is accordingly harmful to the environment.

A solution to this problem is re-usable dispensing containers that may be filled with water and a liquid concentrate (e.g., a concentrated cleaning solution), which are mixed to dilute the concentrate into a usable cleaning solution. One way to implement this solution is concentrated cleaning solution in the form of solid tablets or powder that dissolve in water. Such tablets or powder, however, dissolve slowly which may cause less than desirable mixing of the concentrated cleaning solution and the water. Insufficiently dissolved tablet or powder particles may clog the dispensing container, which is inconvenient for users or may require users to purchase a new dispensing container. Accordingly, concentrated cleaning solution in tablet or powder form may produce a cleaning solution with less than desirable quality. Additionally, a user must physically place a tablet or powder into water in a dispensing container. Since tablets or powder may contain a high level of concentrated chemicals, the tablets or powder may be toxic in their solid form prior to dilution, and thus may expose users to toxic levels of chemicals.

Another way to implement the above solution is concentrated cleaning solution in liquid form, which may mix with water better than solid tablets or powder. One way to add the liquid concentrated cleaning solution to water is to pour (e.g., from a bottle) an amount of the liquid concentrate into a dispensing container partially filled with water. Doing so, however, may result in spilling the liquid concentrate. Such spillage wastes liquid concentrate and may also expose users to toxic chemicals, since the liquid concentrate may contain a high level of concentrated chemicals prior to being diluted with water. Additionally, pouring the liquid concentrate into a dispensing container requires a user to measure a correct amount of liquid concentrate, which may be difficult. Adding an incorrect amount of liquid concentrate may cause the resulting cleaning solution to be over-diluted (e.g., less potent cleaning) or under-diluted (e.g., potentially leaving a toxic level of chemicals in the cleaning solution).

Another way to deliver liquid concentrated cleaning solution to water is through a cartridge that contains a pre-measured amount of liquid concentrate. The concentrated cleaning solution may be contained within a reservoir of the cartridge until it is time to release the concentrate into water. A cartridge and a re-usable dispensing container may interact to release the concentrate from the cartridge and into the re-usable container for ease of use. Once the cleaning solution is all used up, the cartridge may be disposed of or re-filled with concentrated cleaning solution. The re-usable dispensing container may then be used again with a new cartridge or a re-filled cartridge to mix more cleaning solution. In this way, only a new or re-filled cartridge is needed for additional cleaning solution. The cost for consumers and the amount of plastic waste may accordingly be reduced.

An example of a conventional cartridge for delivering liquid concentrated cleaning solution is disclosed in U.S. Pat. No. 6,290,100. The example conventional cartridge, however, relies on a friction fit mechanism for containing and releasing the liquid concentrate, which has a number of drawbacks. The frictional force between an inner and an outer component of the example conventional cartridge must be great enough to maintain the inner and outer components in a closed position until a user desires to release the cartridge's contents. Otherwise, the contents may leak. This frictional force, however, must be overcome in order to release cartridge's contents. A user releases the contents by tightening a dispensing container's cap to force the inner component downward, against the frictional force, to open the cartridge's reservoir and release the concentrated cleaning solution. For some users with reduced strength, such as elderly users, tightening the cap to overcome this frictional force may be difficult or impossible.

Additionally, the friction fit mechanism relies upon contact between the conventional cartridge's inner and outer components at each of their ends. This results in multiple points of potential failure that may render the cartridge inoperable. For instance, the contacting surfaces of the inner and outer components may degrade such that friction is reduced after a certain amount of uses. Another potential drawback of the example conventional cartridge is that the cartridge's inner and outer components may inadvertently slide with respect to one another, such as during transport, which may cause leakage.

Accordingly, a re-usable dispensing container and cartridge system that solves the above drawbacks is desired.

SUMMARY

The present disclosure provides a new and innovative container system for mixing and dispensing a solution, such as a cleaning solution. More specifically, the provided container system is constructed to include a new and innovative cartridge release mechanism to release a cartridge's concentrated solution into a container. In an example, a solution mixing and dispensing system includes a container, a dispenser, and a cartridge. The container has an opening at a threaded neck portion and is constructed to contain a first liquid. The dispenser includes a threaded cap portion, a dip tube, and a sleeve. The threaded cap portion is configured to engage the threaded neck portion of the container to form a fluid-tight seal. The sleeve surrounds a portion of the dip tube and includes a first notch.

The cartridge includes a reservoir, a lip, a channel, and a snap portion. The reservoir is formed by an outer wall and an inner wall of the cartridge, and is fixedly closed at a support end of the cartridge. An interior of the outer wall includes a second notch at a release end of the cartridge. The lip extends outward from the outer wall at the support end of the cartridge. The channel is within the inner wall of the cartridge. The snap portion is configured to engage the second notch to form a fluid-tight seal that closes the reservoir at the release end of the cartridge. The snap portion includes a snap portion opening. The reservoir is constructed to contain a second liquid. The cartridge is positioned within the container such that the lip supports the cartridge on the threaded neck portion of the container.

The dispenser and the cartridge are constructed to interface such that positioning the dip tube and the sleeve through the channel of the cartridge, and engaging the threaded portion of the dispenser with the threaded neck portion of the container, causes the first notch of the sleeve to engage the snap portion and force the snap portion away from the outer wall to open the reservoir.

DETAILED DESCRIPTION

Figure 1:
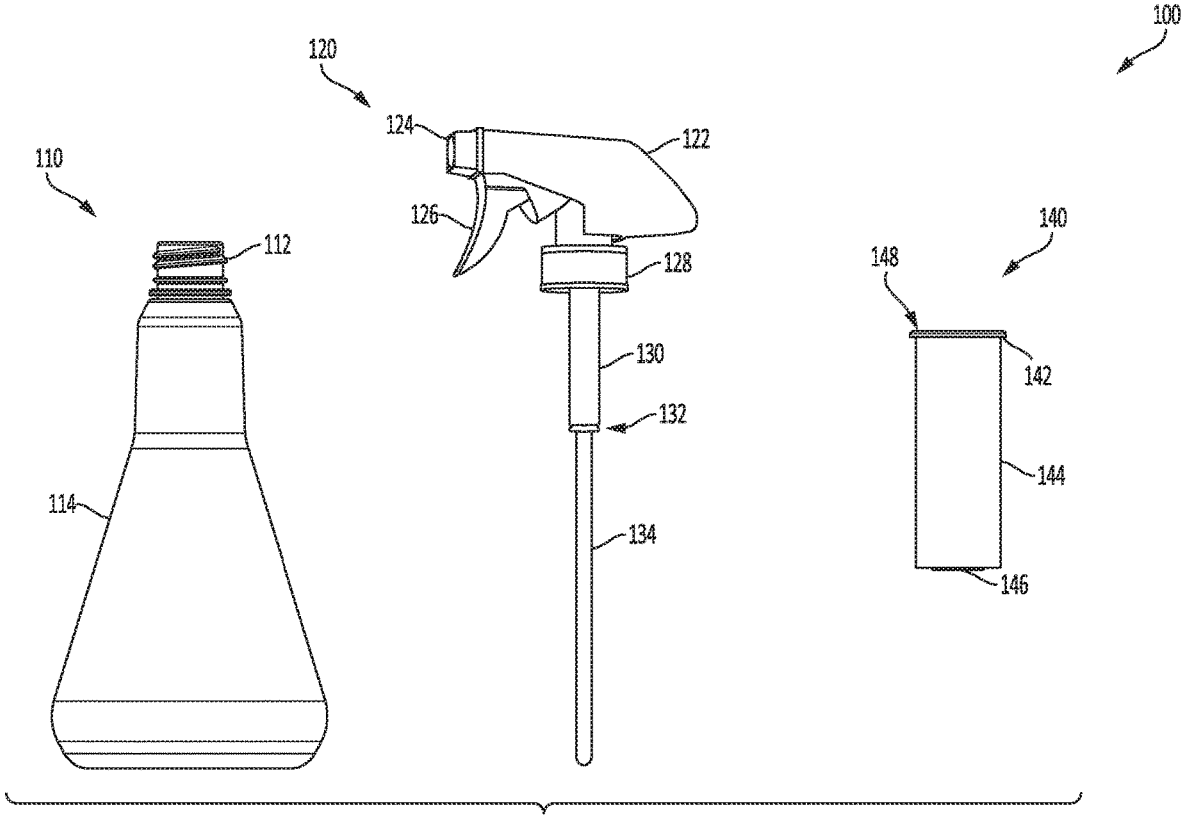
FIG. 1 illustrates a solution mixing and dispensing container system, according to an aspect of the present disclosure.

The present disclosure provides a new and innovative container system for mixing and dispensing a solution, such as a cleaning solution. More specifically, the provided container system is constructed to include a new and innovative cartridge release mechanism to release a cartridge's concentrated solution into a container. The container may include water, which dilutes the concentrated solution to mix a usable solution. The provided container system includes a container, a dispenser, and a cartridge. The dispenser is constructed to dispense a liquid contained within the container. For example, the dispenser may be a sprayer that includes a dip tube, a trigger, and a nozzle. Upon activation of the trigger, liquid may be driven up the dip tube and out the nozzle. The dispenser may also include a threaded cap that is screwed onto a threaded top of the container to form a fluid-tight seal. The dispenser also includes a sleeve surrounding a portion of the dip tube. A notch in the sleeve interacts with the cartridge as part of the provided cartridge release mechanism.

The cartridge of the provided container system includes an inner and an outer wall. Within the inner wall is a channel that extends the cartridge's length. The dispenser's dip tube and sleeve may be positioned through the channel. Between the inner and outer walls is a reservoir. The reservoir may contain a concentrated solution. In some instances the reservoir may be refillable. The reservoir is fixedly closed on a supporting end of the cartridge. On a release end of the cartridge, the cartridge includes a snap portion that snaps into a notch in the outer wall to close the reservoir. The snap portion includes an opening in line with the cartridge's channel. The supporting end of the cartridge includes a lip extending outward from the outer wall so that the cartridge may be supported by the top of the container's opening. Stated differently, the cartridge may be positioned mostly within the container while the lip rests atop the container's opening to maintain the cartridge at the top of the container and prevent it from falling into the container's interior. This positioning enables the cartridge to interact with the dispenser to release the cartridge's contents.

The provided container system releases the cartridge's contents by engaging or tightening (e.g., screwing on) the dispenser's threaded cap to the container's threaded opening. As the dispenser is tightened to the container, the dispenser's sleeve is forced downwards, towards the container's interior. This downward motion causes the sleeve's notch to engage the cartridge's snap portion and force the snap portion to disengage from the cartridge's outer wall so that the snap portion moves with the sleeve, away from the cartridge. Accordingly, the reservoir is opened and its contents, such as concentrated cleaning solution, exit into the container's interior.

The release mechanism of the provided container system provides minimal added resistance to tightening the dispenser's cap onto the container (e.g., as compared to a friction fit). The provided container system therefore provides ease of use for all users, including those with reduced strength, such as elderly users. Additionally, the provided container system's release mechanism only has one potential point of failure, namely the snap portion, which may aid in the container system's long-term reliability. Another advantage of the provided container system is the snap portion is either snapped into or out of the outer wall, which means the cartridge is either closed or open, respectively, and cannot be partially opened. Preventing inadvertent partial opening of the cartridge helps prevent inadvertent leakage.

When the reservoir is in an open state, the snap portion remains engaged with the sleeve. As the dispenser's threaded cap is disengaged or loosened (e.g., unscrewed) from the container, the dispenser's sleeve is forced upwards, away from the container's interior. This upward motion brings the snap portion back to the cartridge and causes it to engage with the notch in the outer wall. The upward motion also then causes the sleeve to disengage from the snap portion, which enables the dispenser to be removed from the container. The cartridge may also be removed from the container and re-filled with concentrated solution to be used again.

FIG. 1 illustrates an example solution mixing and dispensing container system 100. The solution mixing and dispensing container system 100 includes a container 110, a dispenser 120, and a cartridge 140. Each of the container 110, the dispenser 120, and the cartridge 140 may be constructed of a re-usable material, such as a plastic. The container 110 includes a body 114 and a threaded neck portion 112. The body 114 includes a cavity for holding a liquid. The threaded neck portion 112 includes an opening to allow access to the cavity of the body 114. The container 110 is constructed to contain a liquid.

The dispenser 120 is constructed to dispense a liquid contained within the container 110. For example, the liquid may be a cleaning solution, cleaning-based liquid, solvent, water-based cleaning liquid, solute-based liquid, or other type of liquid. The dispenser 120 may include a dispenser head 122, a nozzle 124, a trigger 126, and a dip tube 134 that operate together to dispense liquid in the container 110. For instance, the dip tube 134 may be positioned within the container 110 and squeezing the trigger 126 creates suction that drives liquid into and up the dip tube 134 and out the nozzle 124. In some instances, the nozzle 124 may be adjusted (e.g., rotated) to cycle between different dispensing modes (e.g., on, off, spray, stream, etc.). The dispenser 120 may also include a threaded cap portion 128 configured to engage with the threaded neck portion 112 of the container 110. When the threaded cap portion 128 is engaged with the threaded neck portion 112, a fluid-tight seal is created, which prevents liquid from exiting the container 110 without squeezing the trigger 126.

As part of a concentrate release mechanism of the present disclosure, the dispenser 120 includes a sleeve 130 that surrounds a portion of the dip tube 134. The sleeve 130 includes a notch 132. The notch 132 is particularly positioned on the sleeve 130 to interface with the cartridge 140, as will be described in more detail below. The dispenser 120 is further described in connection with FIG. 2 below.

The cartridge 140 includes a body portion having an outer wall 144. At one end of the outer wall 144, the cartridge 140 includes a cap 148. The cap 148 includes a lip 142 that extends outward from the outer wall 144. At the other end of the outer wall 144, the cartridge 140 includes a snap portion 146. The snap portion 146 may engage and disengage with (e.g., snap into and out of) the outer wall 144. The cartridge 140 may be positioned partially within the container 110 such that the body portion of the cartridge 140 is within the container 110 while the lip 142 rests on the top of the threaded neck portion 112 of the container 110. The cartridge 140 will be further described in connection with FIG. 3 below.

Figure 2:
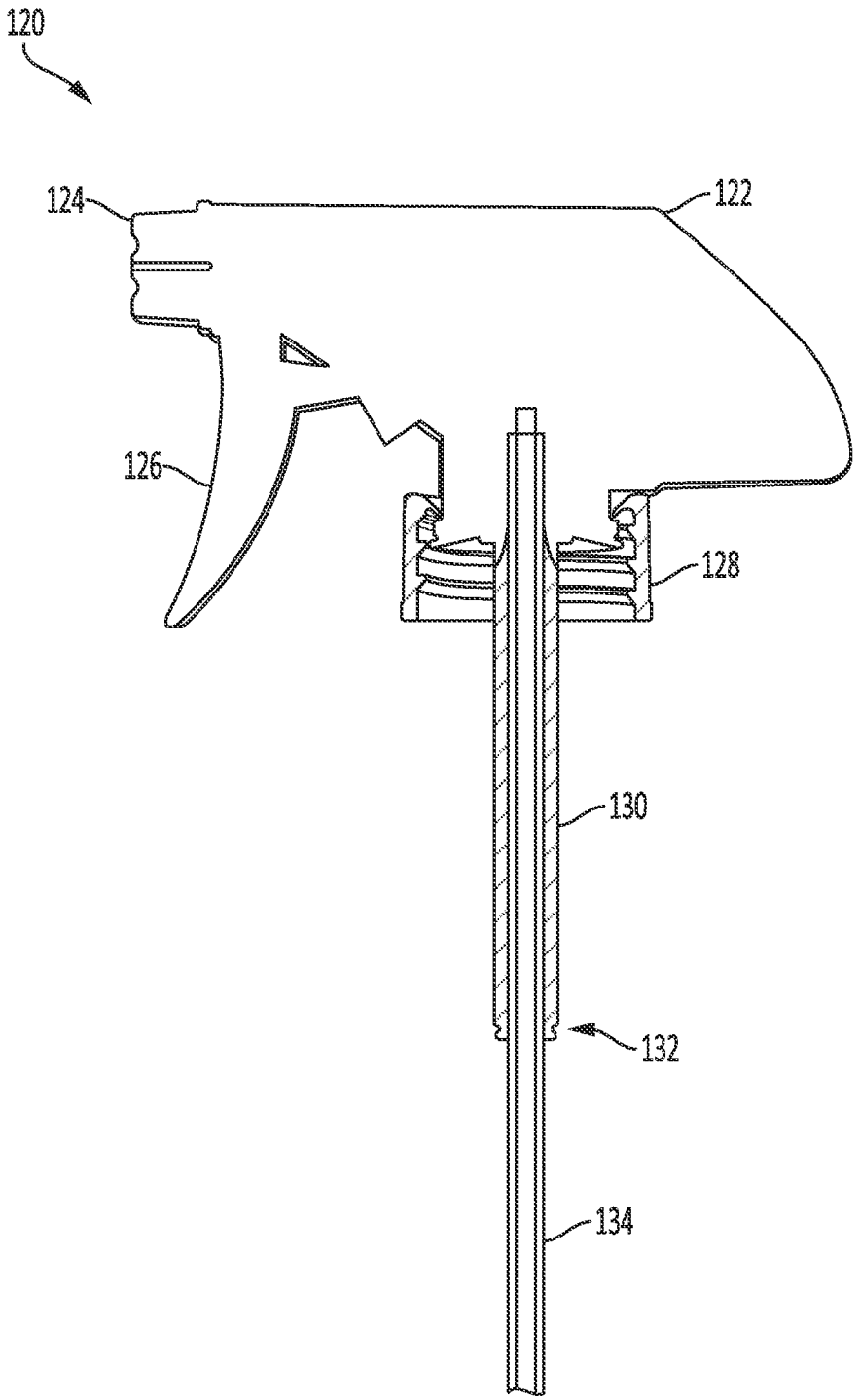
FIG. 2 illustrates a cross-section of a dispenser having a sleeve surrounding a portion of a dip tube, according to an aspect of the present disclosure.

FIG. 2 illustrates a cross-section of the example dispenser 120 to further illustrate the sleeve 130 surrounding a portion of the dip tube 134. In some instances, the sleeve 130 may be a separate component that is attached to the dip tube 134. In other instances, the sleeve 130 may be formed integrally with the exterior of the dip tube 134. It should be appreciated that the internal mechanisms of the dispenser head 122 that enable liquid to travel from the dip tube 134 out the nozzle 124 are not illustrated.

Figure 3:
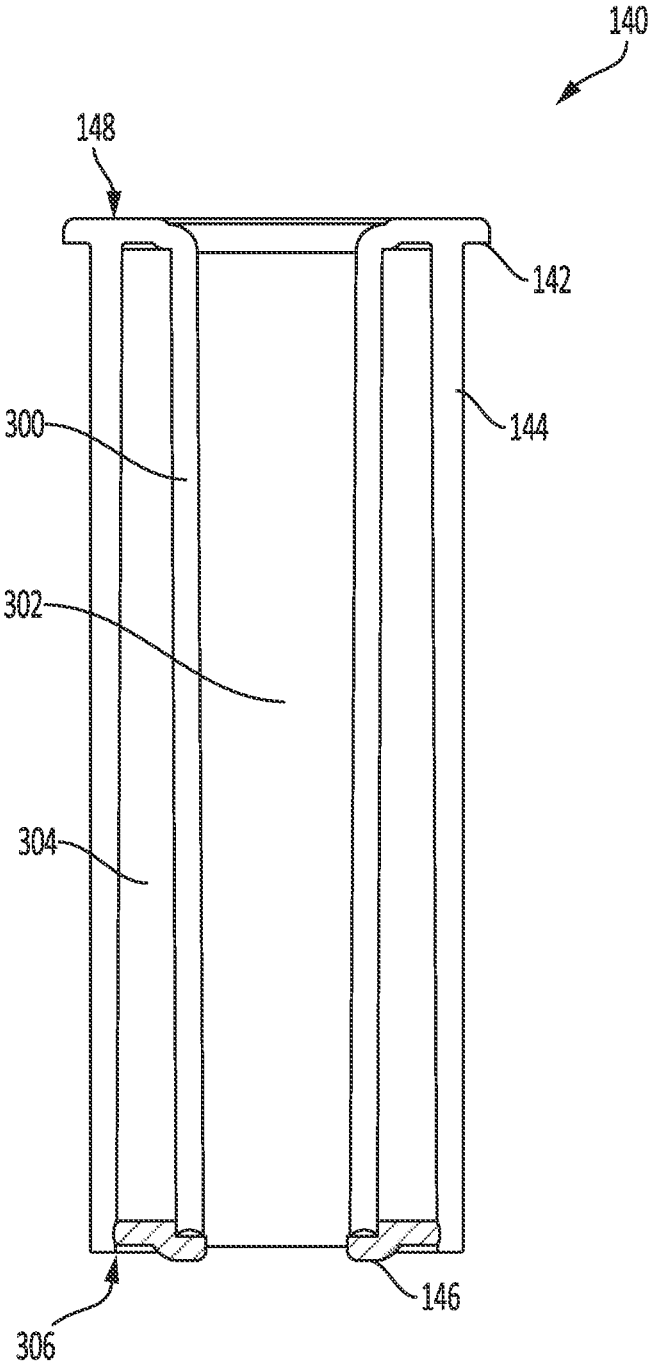
FIG. 3 illustrates a cross-section of a cartridge, according to an aspect of the present disclosure.

FIG. 3 illustrates a cross-section of the example cartridge 140. It should be appreciated that components are only indicated on one of their mirror-image sides for the sake of clarity given the cross-sectional nature of the figure. For instance, the cartridge 140 may be cylindrical. As described above, the cartridge 140 includes a body portion having an outer wall 144 with a cap 148 having a lip 142 at one end of the outer wall 144. The cartridge 140 also includes an inner wall 300. The inner wall 300 forms a channel 302 that extends the length of the cartridge 140. For example, the dip tube 134 of the dispenser 120 may be inserted through the channel 302. In some instances, the cap 148 may be a separate component that is attached to the outer wall 144 and the inner wall 300. In other instances, such as the illustrated example, the cap 148 may be formed integrally with the outer wall 144 and the inner wall 300.

The snap portion 146 may engage and disengage with the outer wall 144 at an interface 306. For example, the outer wall 144 may include a notch (e.g., the notch 502 in FIG. 5) that the snap portion 146 fits within to engage with the outer wall 144. When the snap portion 146 is engaged with the outer wall 144, the snap portion 146 seals a reservoir 304 within the cartridge 140. The reservoir 304 is fixedly closed by the cap 148 at its other end. A liquid (e.g., a concentrate or concentrated cleaning solution) may be stored within the reservoir 304. Upon the snap portion 146 being disengaged from the outer wall 144, the reservoir 304 is opened and the stored liquid exits the reservoir 304. Examples of a concentrate or concentrated cleaning solution may include concentrated glass cleaning solution, bathroom cleaning solution, floor cleaning solution, or kitchen or countertop cleaning solution.

Figure 4A:
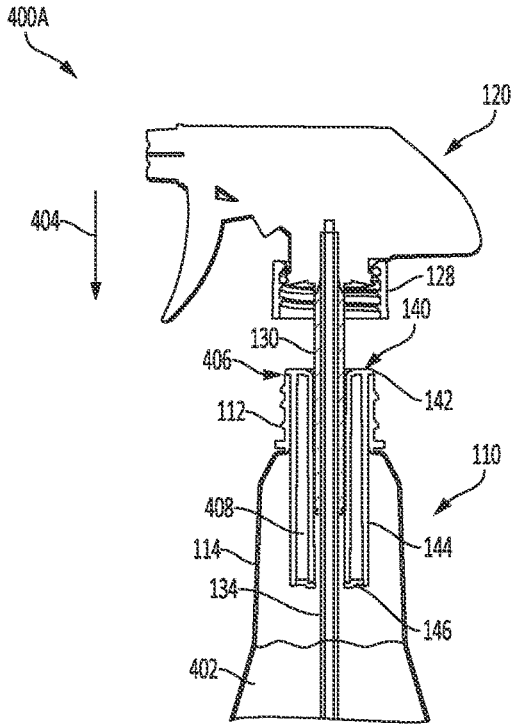
FIGS. 4A to 4D illustrate cross-sections of a process for releasing concentrated cleaning solution from a cartridge into a container, according to an aspect of the present disclosure.

The container 110, the dispenser 120, and the cartridge 140 of the solution mixing and dispensing container system 100 operate together to release a liquid contained within the reservoir 304 of the cartridge 140 into the container 110. FIGS. 4A to 4D illustrate cross-sections of an example process of such components operating together for releasing concentrated cleaning solution from a cartridge 140 into a container 110. FIG. 4A illustrates process step 400A in which a cartridge 140 is positioned partially within the container 110. The lip 142 is exterior to the container 110 and rests on the threaded neck portion 112 of the container 110 at the interface 406. The lip 142 supports the cartridge 140 on the threaded neck portion 112 and prevents the cartridge 140 from completely entering the container 110. The reservoir 304 (not indicated) of the cartridge 140 is filled with a concentrated cleaning solution 408. The container 110 is filled with water 402. The dip tube 134 is inserted through the channel 302 (not indicated) of the cartridge 140 and into the container 110 as the dispenser 120 is translated towards the container 110 in the direction of the arrow 404.

Figure 4B:
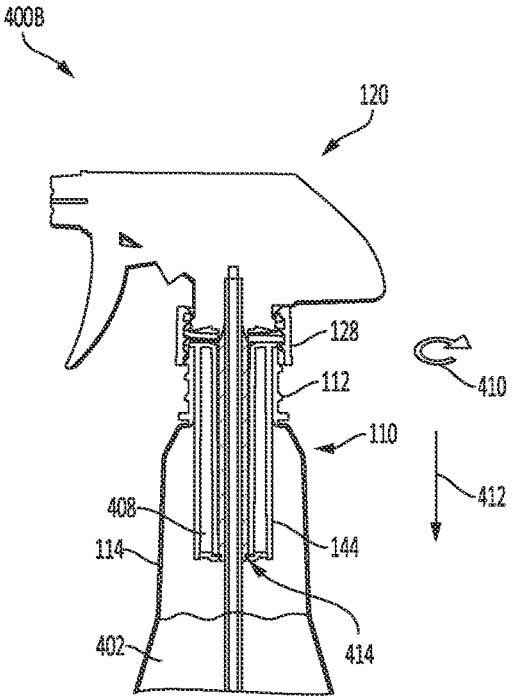

FIG. 4B illustrates the process step 400B in which the dip tube 134 is inserted within the container 110 and the threaded cap portion 128 of the dispenser 120 contacts the threaded neck portion 112 of the container 110. At this point, the sleeve 130 contacts or engages the snap portion 146 at the interface 414. The reservoir 304 remains filled with the concentrated cleaning solution 408. As the threaded cap portion 128 is engaged with the threaded neck portion 112 (e.g., the threaded cap portion 128 is rotated in direction of the arrow 410), the dispenser 120 is forced towards the container 110 in the direction of the arrow 412. At the same time, the notch 132 in the sleeve 130 engages the snap portion 146, if it has not already, and forces the snap portion 146 to disengage from the outer wall 144 and translate away from the cartridge 140. In some instances, the threaded cap portion 128 may be rotated independently of the sleeve 130.

Figure 4C:
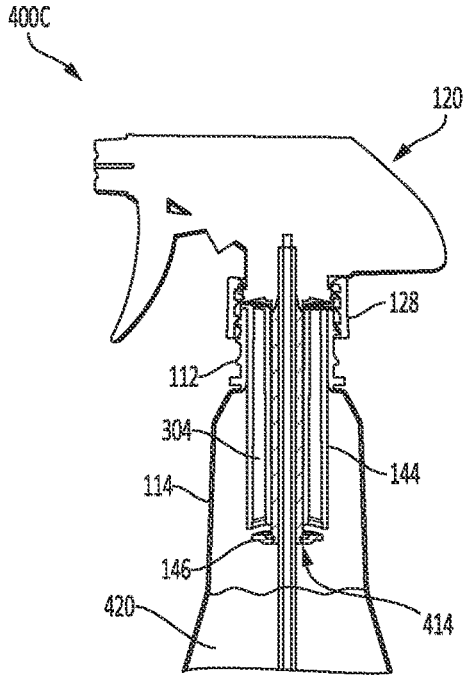

The threaded cap portion 128 may be fully tightened onto the threaded neck portion 112. This creates a fluid-tight seal so that liquid does not escape the container 110 aside from operation of the dispenser 120. The end result after fully tightening the threaded cap portion 128 is illustrated in FIG. 4C in the process step 400C. The snap portion 146 is translated away from the cartridge 140 as it remains engaged with the sleeve 130 at the interface 414. This opens the reservoir 304 and releases the concentrated cleaning solution 408 into the water 402 in the container 110. The concentrated cleaning solution 408 and the water 402 mix to form a cleaning solution 420. The cleaning solution 420 may then be dispensed as needed via the dispenser 120.

Figure 4D:
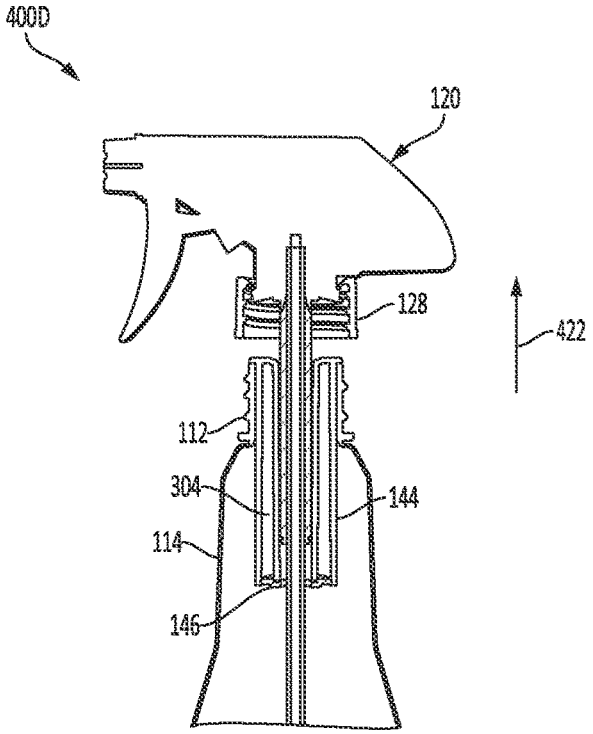

Once all or most of the cleaning solution 420 has been dispensed and the container 110 is empty or mostly empty, the threaded cap portion 128 may be disengaged form the threaded neck portion 112 to remove the dispenser 120 from the container 110. The process step 400D illustrated in FIG. 4D shows this operation. Disengaging the threaded cap portion 128 from the threaded neck portion 112 causes the dispenser 120 to translate away from the container 110 in the direction of the arrow 422. Because the snap portion 146 remains engaged with the sleeve 130, the snap portion 146 is translated in the direction of the arrow 422 until it re-engages (e.g., snaps into a notch) with the outer wall 144 of the cartridge 140. Once the snap portion 146 is engaged with the outer wall 144, further translation of the dispenser 120, and thus the sleeve 130, in the direction of the arrow 422 causes the sleeve 130 to disengage from the snap portion 146. The re-engagement of the snap portion 146 with the outer wall 144 and disengagement of the sleeve 130 from the snap portion 146 may all occur while the threaded cap portion 128 is being disengaged (e.g., screwed off) from the threaded neck portion 112. The dispenser 120 may then be translated in the direction of the arrow 422 until the dip tube 134 is completely removed from the container 110.

The re-engagement of the snap portion 146 to the outer wall 144 of the cartridge 140 enables the cartridge 140 to be re-usable. The cartridge 140 may be removed from the container 110 and positioned such that the cap 148 is beneath the snap portion 146 (e.g., the opposite orientation of the cartridge 140 in the container 110). The snap portion 146 may be disengaged from the outer wall 144 either manually or via a tool or machine to open the reservoir 304. The reservoir 304 may then be re-filled with concentrated cleaning solution 408. The snap portion 146 may be then be re-engaged with the outer wall 144 to seal the reservoir 304. The cartridge 140 is thus re-filled and may be used again with the same container 110 and dispenser 120 to mix cleaning solution (e.g., the process steps 400A to 400C).

Figure 5:
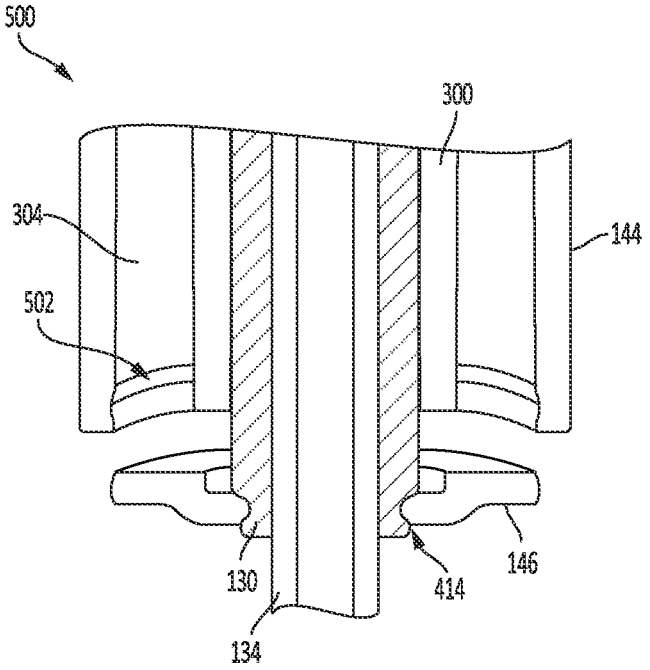
FIG. 5 illustrates a magnified cross-sectional perspective view of a cartridge in an open state, according to an aspect of the present disclosure.

FIG. 5 illustrates a magnified cross-sectional perspective view of an open state 500 of the cartridge 140 to further illustrate the concentrate release mechanism. The sleeve 130 is shown engaged with the snap portion 146 at the interface 414. The snap portion 146 is positioned within the notch 132 (not indicated) such that the snap portion 146 remains engaged with the sleeve 130 as the sleeve 130 is translated. The notch 502 of the outer wall 144 of the cartridge 140 is also illustrated. The snap portion 146 may engage and disengage with the notch 502, as described above, to seal the reservoir 304 or to open the reservoir 304, respectively. When engaged with the outer wall 144, the snap portion 146 is positioned within the notch 502 to form a fluid-tight seal with the inner wall 300. An external force (e.g., the sleeve 130 being forced into the container 110) is required to disengage the snap portion 146 from the notch 502 in the outer wall 144.

The presently disclosed concentrate release mechanism of the solution mixing and dispensing container system 100 enables the reservoir 304 to be in an open position or a closed position. There is no middle ground. Stated differently, the snap portion 146 is either engaged with the inner wall 300 within the notch 502 to close the reservoir 304 or is disengaged with the inner wall 300 to open the reservoir 304. Preventing inadvertent partial opening of the reservoir 304 helps prevent inadvertent leakage.

Without further elaboration, it is believed that one skilled in the art can use the preceding description to utilize the claimed inventions to their fullest extent. The examples and aspects disclosed herein are to be construed as merely illustrative and not a limitation of the scope of the present disclosure in any way. It will be apparent to those having skill in the art that changes may be made to the details of the above-described examples without departing from the underlying principles discussed. In other words, various modifications and improvements of the examples specifically disclosed in the description above are within the scope of the appended claims. For instance, any suitable combination of features of the various examples described is contemplated.

The invention is claimed as follows:

1. A solution mixing and dispensing container system comprising:

a container having a container opening at a threaded neck portion, wherein the container is constructed to contain a first liquid;

a dispenser including:

a threaded cap portion configured to engage the threaded neck portion of the container to form a fluid-tight seal, a dip tube, and a sleeve surrounding a portion of the dip tube, wherein the sleeve includes a first notch; and a cartridge including:

a reservoir formed by an outer wall and an inner wall of the cartridge, wherein the reservoir is fixedly closed at a support end of the cartridge, wherein an interior of the outer wall includes a second notch at a release end of the cartridge, a lip extending outward from the outer wall at the support end of the cartridge, a channel within the inner wall of the cartridge, and a snap portion configured to engage the second notch to form a fluid-tight seal that closes the reservoir at the release end of the cartridge, wherein the snap portion includes a snap portion opening, wherein the reservoir is constructed to contain a second liquid, wherein the cartridge is positioned within the container such that the lip supports the cartridge on the threaded neck portion of the container, wherein the dispenser and the cartridge are constructed to interface such that positioning the dip tube and the sleeve through the channel of the cartridge, and engaging the threaded portion of the dispenser with the threaded neck portion of the container, causes the first notch of the sleeve to engage the snap portion and force the snap portion away from the outer wall to open the reservoir.

2. The solution mixing and dispensing container system of claim 1, wherein the container contains water.

3. The solution mixing and dispensing container system of claim 2, wherein the reservoir contains a concentrated solution.

4. The solution mixing and dispensing container system of claim 3, wherein opening the reservoir releases the concentrated solution into the water contained in the container to form a solution.

5. The solution mixing and dispensing container system of claim 1, wherein upon the reservoir opening, the second liquid contained within the reservoir mixes with the first liquid contained within the container thereby forming a mixture liquid, and wherein the dispenser is configured to dispense the mixture liquid contained within the container.

6. The solution mixing and dispensing container system of claim 1, wherein the reservoir of the cartridge is refillable.

7. The solution mixing and dispensing container system of claim 1, wherein the lip is formed integrally with the outer wall.

8. The solution mixing and dispensing container system of claim 1, wherein the first notch of the sleeve engages the snap portion at the snap portion opening.

9. The solution mixing and dispensing container system of claim 1, wherein the dispenser and the cartridge are constructed such that the first notch of the sleeve remains engaged with the snap portion as the snap portion is forced away from the outer wall.

10. The solution mixing and dispensing container system of claim 1, wherein disengaging the threaded cap portion of the dispenser with the threaded neck portion of the container causes the snap portion to engage the second notch of the outer wall.

11. The solution mixing and dispensing container system of claim 1, wherein disengaging the threaded cap portion of the dispenser with the threaded neck portion of the container causes the sleeve to disengage from the snap portion.

12. The solution mixing and dispensing container system of claim 1, wherein forcing the snap portion away from the outer wall includes causing the snap portion to disengage from the outer wall.

13. A solution mixing and dispensing container system comprising:

a container containing water, the container having a container opening at a threaded neck portion;

a dispenser including:

a threaded cap portion configured to engage the threaded neck portion of the container to form a fluid-tight seal, a dip tube, and a sleeve surrounding a portion of the dip tube, wherein the sleeve includes a first notch; and a cartridge positioned partially within the container, the cartridge including:

a cap including a lip extending outward from an outer wall of the cartridge at a support end of the cartridge, the lip positioned on the threaded neck portion of the container, a snap portion configured to engage and disengage a second notch in an interior of the outer wall at a release end of the cartridge, the snap portion including a snap portion opening, a reservoir containing a concentrated cleaning solution, the reservoir formed by the cap, the snap portion, the outer wall and an inner wall of the cartridge, and a channel within the inner wall of the cartridge, wherein the dip tube is positioned within the container via the channel and the snap portion opening, and wherein the dispenser and the cartridge are constructed to interface such that engaging the threaded cap portion of the dispenser with the threaded neck portion of the container causes the first notch of the sleeve to engage the snap portion and force the snap portion away from the outer wall to open the reservoir.

14. The solution mixing and dispensing container system of claim 13, wherein the snap portion engaged with the second notch forms a fluid-tight seal.

15. The solution mixing and dispensing container system of claim 13, wherein the cartridge is constructed of a plastic.

16. The solution mixing and dispensing container system of claim 13, wherein the cartridge is cylindrical.

17. The solution mixing and dispensing container system of claim 13, wherein the dip tube is fixedly attached to the threaded cap portion.

18. The solution mixing and dispensing container system of claim 13, wherein the sleeve is fixedly attached to the threaded cap portion.

19. The solution mixing and dispensing container system of claim 13, wherein the sleeve is integral with the dip tube.

20. The solution mixing and dispensing container system of claim 13, wherein the threaded cap portion rotates independently of the sleeve.

* * * * *